US005405189A

United States Patent [19]

Stumpf

[11] Patent Number: 5,405,189

[45] Date of Patent: Apr. 11, 1995

[54] CHAIR SEAT BACK HEIGHT ADJUSTMENT MECHANISM

[75] Inventor: William S. Stumpf, Kitchener, Canada

[73] Assignee: Doerner Products Ltd., Waterloo, Canada

[21] Appl. No.: 103,252

[22] Filed: Aug. 9, 1993

[51] Int. Cl.[6] ..... B60N 2/02

[52] U.S. Cl. ..... 297/353; 297/410

[58] Field of Search ..... 297/353, 410, 411.36

[56] References Cited

U.S. PATENT DOCUMENTS

| | | | |
|---|---|---|---|
| 360,855 | 4/1887 | Cooper | 297/353 X |
| 2,509,102 | 5/1950 | Kuebler | 297/353 |
| 3,738,706 | 6/1973 | Caldemeyer | 297/410 |
| 4,181,357 | 1/1980 | Swenson et al. | 297/353 |
| 4,560,202 | 12/1985 | Koelle et al. | 297/410 |
| 4,632,458 | 12/1986 | Brown et al. | 297/353 |

*Primary Examiner*—Laurie K. Cranmer
*Attorney, Agent, or Firm*—Jacobson, Price, Holman & Stern

[57] ABSTRACT

An improved seat back height adjustment mechanism for a chair is disclosed. The improved height adjustment mechanism includes a U-shaped mounting bracket having a back wall and two side walls. A longitudinal shaft having a handwheel is rotatably mounted in the bracket between the side walls and spaced from the back wall. A seat back support arm is insertable through the bracket between the shaft and the bracket back wall. A back plate provided with a rack and an adjacent planar surface both extending along the length of the back plate is mounted onto the seat back support arm. In one aspect, the shaft is provided with a pinion for engaging the rack and a multi-sided, symmetrical cam adjacent the pinion for locking the shaft against free rotation. When assembled, the rack and the planar surface of the back plate are aligned with the pinion and cam respectively. When the shaft is rotated via the handwheel, the pinion rotates and engages the rack thereby causing the seat back support arm to be vertically displaced with respect to the mounting bracket. When a planar face of the cam is contiguous with the planar surface of the back plate shaft rotation is resisted thereby locking the height adjustment mechanism.

18 Claims, 3 Drawing Sheets

CHAIR SEAT BACK HEIGHT ADJUSTMENT MECHANISM

FIELD OF THE INVENTION

The present invention relates to height adjustment mechanisms for chair seat backs.

BACKGROUND OF THE INVENTION

Comfortable and ergonomic office equipment, readily adaptable to a user's individual needs is a prerequisite for creating an office work environment conducive to maximum productivity. Chairs are an integral part of any office environment and features which can be adjusted to meet a user's posture requirements play a pivotal role in contributing to a user's comfort level. In particular, chairs having height adjustable backrests or seat backs are important for adapting the chair to the user's posture needs. The chair seat back is attached to the rest of the chair by a support arm attached at one end to the seat back and the other end of the support arm is engaged by a seat back height adjustment mechanism attached to the chair.

Known seat back height adjustment mechanisms include a cam rotatably mounted in a bracket. The cam comprises a shaped cylindrical rod having a handle attached thereto such that rotation of the rod via the handle provides a cam action. The cam is rotatably mounted between the side walls of the mounting bracket spaced from a back wall of the bracket. The support arm is slidably received between the bracket back wall and the cam. To adjust the seat back to the desired height, the cam is first rotated so that it disengages from the support arm thereby leaving the support arm free to be adjusted; once the support arm is adjusted to the desired height the cam is rotated to engage the support arm thereby compressing the arm between the cam-shaped portion and the back wall of the bracket to lock the seat back at the desired vertical height.

One drawback to this arrangement is that the user requires the use of two hands to take the necessary steps to adjust the seat back to the desired height: one hand to vertically move the seat back and hold it at the desired height, and the other to rotate the cam using the handle. Furthermore, in order for the cam to engage and lock the seat back support arm, a positive locking action between the cam and support arm is required, the user must rotate the cam such that the cam is tightly engaged, compressing the arm between it and the back wall of the bracket.

Accordingly, it would be advantageous to provide a chair seat height adjustment mechanism which can be manipulated using one hand and having a passive locking means.

SUMMARY OF THE INVENTION

The present invention provides a height adjustment mechanism for a chair having a base portion and a seat back, the chair being of the type including a support arm attached to the seat back, the support arm having a rack extending there along. The mechanism comprises a mounting bracket attachable to the base portion of the chair, the mounting bracket for slidable reception of the support arm attached to the seat back of the chair and a shaft member mounted to the mounting bracket for rotation about a rotational axis, the shaft member including means to facilitate its rotation, a pinion, and a cam means. The cam means has a plurality of circumferentially spaced outwardly protruding portions and the shaft member is positioned such that when the support arm is received by the mounting bracket, the pinion meshingly engages the rack and the cam means is in contiguous relationship with the support arm such that free rotation of the shaft is prevented by at least one of the protruding portions of the cam means. One of the cam means and a portion of the support arm in contiguous relationship therewith is sufficiently resilient that, upon the application of sufficient torque to the shaft member, one of the protruding portions of the cam means moves along the support arm as the cam means is rotated such that the pinion engaging the rack rotates and displaces the support arm with respect to the mounting bracket.

According to another aspect, the present invention provides a chair comprising a chair base and a seat back, one of the seat back and the chair base having a support arm attached thereto, and the other having a mounting bracket attachable thereto. The mounting bracket slidingly receiving the support arm. A rack extending along the support arm, and a shaft member mounted to the mounting bracket for rotation about a rotational axis. The shaft member including means to facilitate its rotation, a pinion, and a cam means. The cam means having a plurality of circumferentially spaced outwardly protruding portions. The shaft member being positioned such that when the support arm is received by the mounting bracket, the pinion meshingly engages the rack and the cam means is in contiguous relationship with the support arm such that free rotation of the shaft is prevented by at least one of the protruding portions of the cam means. One of the cam means and a portion of the support arm in contiguous relationship therewith is sufficiently resilient that, upon the application of sufficient torque to the shaft member, one of the protruding portions of the cam means moves along the support arm as the cam means is rotated such that the pinion engaging the rack rotates and displaces the support arm with respect to the mounting bracket.

BRIEF DESCRIPTION OF THE DRAWINGS

The following is a description, by way of example only, of a chair seat back height adjustment mechanism forming the subject invention, reference being had to the accompanying drawings, in which.

DETAILED DESCRIPTION OF THE INVENTION

Figure 1:
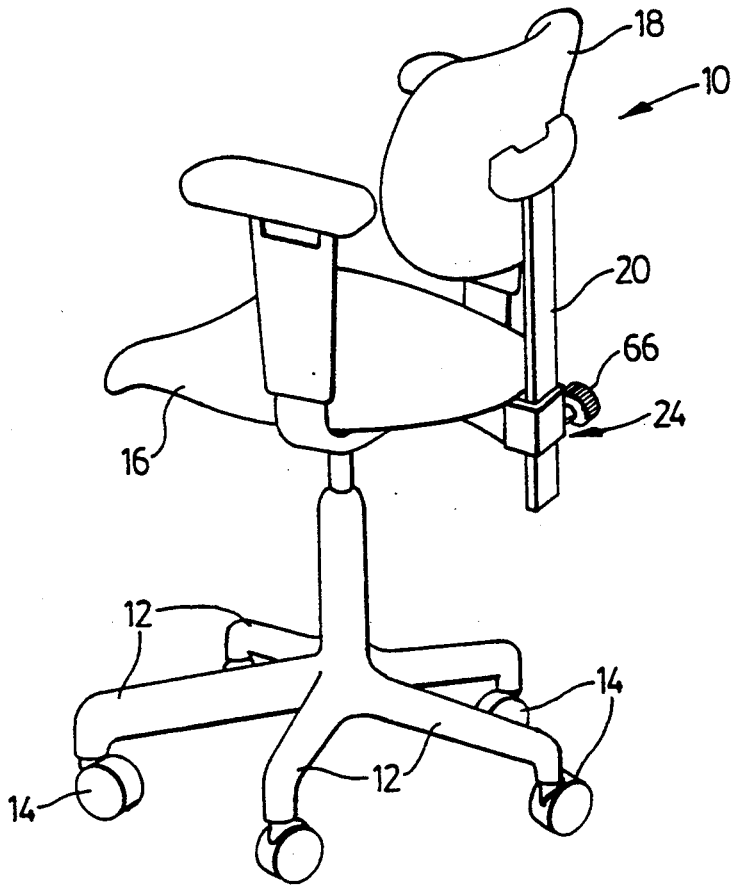
FIG. 1 is a perspective view of a chair provided with a seat back height adjustment mechanism embodying the present invention.

In the ensuing description of the structure and operation of the seat back height adjustment mechanism for a chair seat back embodying the subject invention, reference will be made to the Figures wherein like numerals refer to like parts. FIG. 1 shows a chair 10 of the type generally found in an office environment. Chair 10 includes supporting legs 12 each having a castor 14 attached at a lower end thereof. Chair 10 is provided with a seat 16 and a seat back 18 attached to one end of a seat back support arm 20. The other end of support arm 20 is operably engaged with a seat back height adjustment mechanism shown generally at 24.

Figure 2:
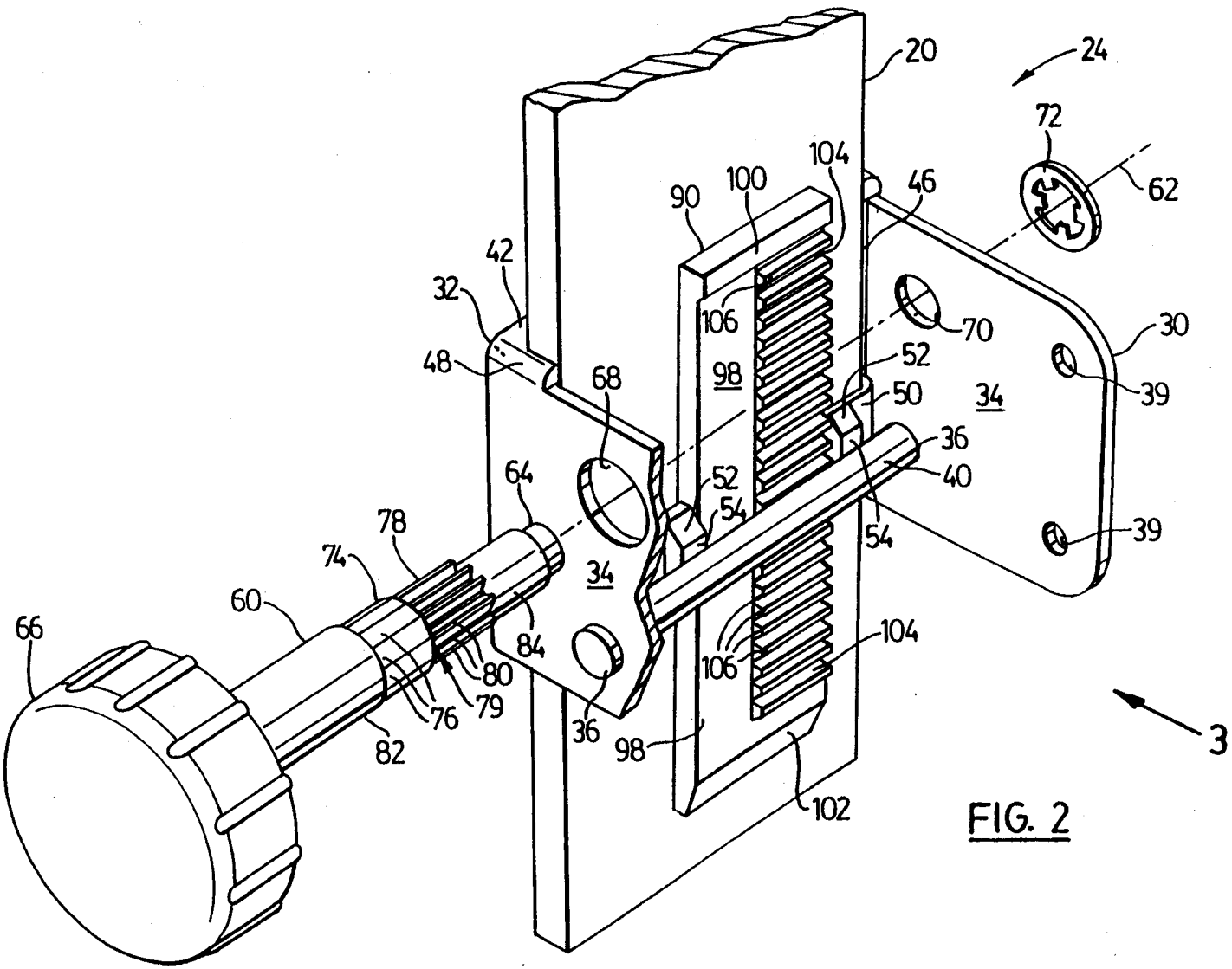
FIG. 2 is a perspective view, broken away, showing a partially assembled seat back height adjustment mechanism forming the present invention.

Referring to FIGS. 1 and 2, seat back height adjustment mechanism 24 comprises a rectangular U-shaped mounting bracket or clevis 30 provided with an end wall 32 and opposing side walls 34. Mounting bracket or clevis 30 receives arm 20 between side walls 34. Mounting bracket 30 is provided with a rod 40 extending between and attached to side walls 34 through holes 36 spaced above the bottom edge of the bracket side walls. Holes 39 in side walls 34 are for securing bracket 30 to the rest of the chair at a position behind the seat, see FIG. 1.

Figure 4:
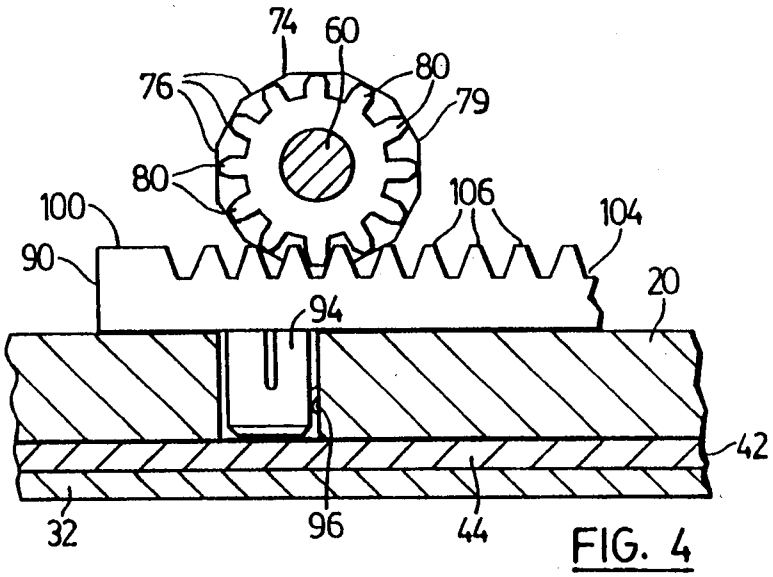
FIG. 4 is a sectional side view taken along line 4—4 of FIG. 3.
Figure 3:
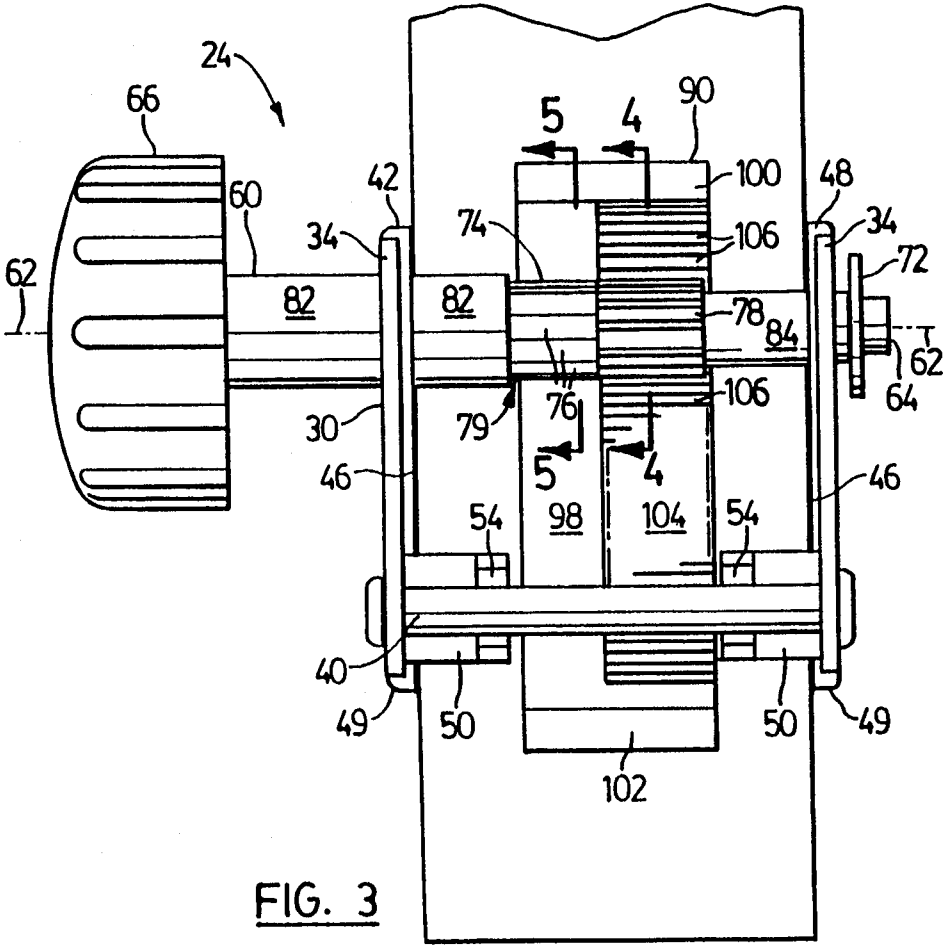
FIG. 3 is a frontal view along arrow 3 of FIG. 2 with the height adjustment mechanism assembled.

Referring to FIGS. 2 to 4, a moulded plastic insert 42 snap fits into mounting bracket 30 against the interior face of end wall 32 of the bracket. Insert 42 includes a back wall 44 (see FIG. 4), sides 46 and an upper lip 48 (see FIGS. 2,3) extending along the upper edges of wall 44, and a lower lip 49 (see FIG. 3), which extends along the lower edges of the wall and sides. Lips 48 and 49 extend over the upper and lower edges respectively of end wall 32 and a portion of side walls 34 thereby holding insert 42 to mounting bracket 30.

Referring to FIG. 3, insert 42 also includes arms 50 extending one from each side 46 adjacent the bottom edges of side walls 46. Arms 50 are in spaced, opposing relationship to each other with a gap located therebetween and each terminate in a raised portion 52 having a concave surface 54 dimensioned so that when insert 42 is attached to bracket 30, rod 40 bears against portions 54 thereby pushing brackets 50 towards back wall 32 compressing arm 20 therebetween which aids in retaining the insert on mounting bracket 30. Back wall 44 may be provided with a toughened surface for increasing the friction between support arm 20 and insert 42.

Height adjustment mechanism 24 includes an elongate shaft 60 having a rotational axis 62, a free end 64 and a handwheel 66 mounted on the other end of the shaft. Shaft 60 is mounted for rotation in side walls 34 through holes 68 and 70. A lock washer 72 snapped over free end 64 of shaft 60 locks the shaft in position on mounting bracket 30.

Figure 5:
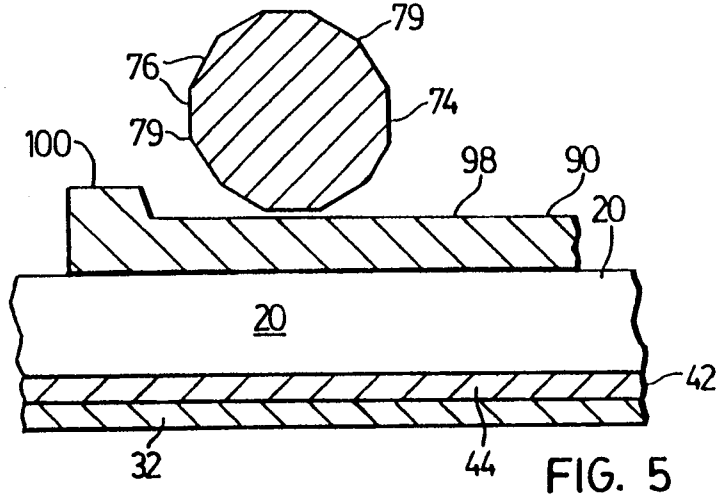
FIG. 5 is a sectional side view taken along line 5—5 of FIG. 3.

Shaft 60 includes a cam 74 comprising a plurality of planar faces 76 and a pinion 78 provided with a plurality of cogs or teeth 80 with the pinion and cam integrally formed with shaft 60 and located adjacent each other. With specific reference to FIG. 5, adjacent planar faces 76 meet along an edge 79. All points along each edge 79 has a greater diameter than the midpoint of planar surfaces 76 which produces a cam action on any member adjacent a surface 76 during rotation of shaft 60 about axis 62.

Rotatably mounted shaft 60 has handwheel 66 located outside mounting bracket 30 and pinion 78 and cam 74 located inside mounting bracket 30, best seen in FIG. 3. Shaft 60 includes a cylindrical portion 82 adjacent handle 66 of a suitable diameter to be received by hole 68 and a smaller diameter cylindrical portion 84 adjacent end portion 64 of a suitable diameter to be received by smaller hole 70.

Height adjustment mechanism 24 includes a rectangular back plate 90 mounted and positioned on seat back support arm 20 in the gap between the ends of spaced arms 50. Referring specifically to FIG. 4, back plate 90 is secured to support arm 20 by means of two pegs 94 (only one shown in FIG. 4) integrally formed therewith. Pegs 94 may be shaped and dimensioned in one of a plurality of known ways to form a snap fitting connection with support arm 20 when inserted into holes 96. Back plate 90 includes a planar surface 98, a raised upper edge 100, a tapered bottom edge 102, and a rack 104 adjacent planar surface 98 comprising a plurality of adjacent teeth 106 extending from upper edge 100 to bottom edge 102 and adjacent planar surface 98.

When height adjustment mechanism 24 is assembled as illustrated in FIG. 3, cam 74 is adjacent planar surface 98 and pinion 78 is meshed with the teeth on rack 104. The matching of holes 68 and 70 with cylindrical sections 82 and 84 respectively ensure that assembly 24 is correctly assembled with pinion 78 and cam 74 properly aligned with back plate 90.

Those skilled in the art will appreciate that numerous other configurations are possible. For example, handwheel 66 and rod 60 may be integrally formed with bracket 30 as a one piece unit rather than as separate elements as shown herein. In addition, the handwheel 66 can be fitted to suit either left or right handed users. In addition, the height adjustment mechanism may be constructed with two embodiments with one for use by the left hand of a user sitting in the chair and the other for use by the right hand of a user. Alternatively, a height adjustment mechanism having two handwheels 66 adjacent each side wall 34 may be provided.

Referring to FIGS. 1 to 5, the operation of seat back height adjustment mechanism 24 will now be described. Back plate 90 is attached to support arm 20 and bracket 30, with insert 42 in place, is mounted on support arm 20 with rod 40 received on concave surfaces 54 of arms 50. Tapered lower edge 102 of back plate 90 permits support arm 20 and plate 90 to be inserted between rod 40 and bracket 30 from the top of the bracket. The dimensions of support arm 20, bracket 30 and insert 42 are chosen so that when assembled there is a tight fit between all the aforementioned components. Teeth or cogs 80 of pinion 78 mesh with teeth 106 of rack 104 and cam 74 is located adjacent planar portion 98. Lock washer 72 is secured to end portion 64 to secure rod 60 to bracket 30.

To adjust the height of support arm 20 and therefore seat back 18 (shown in FIG. 1), handwheel 66 is rotated whereby pinion 78 of shaft 60 rotates and engages teeth 106 on rack 104 thereby displacing support arm 20 vertically with respect to seat 16. In the embodiment shown, shaft 60 does not freely rotate because a planar face 76 of cam 74 is contiguous with planar surface 98 of back plate 90 so that the shaft is locked in position until rotated with sufficient force to rotate edge 79 over surface 98. The area of planar faces 76 is chosen to ensure shaft 60 is locked against freely rotating unless deliberately rotated by a user.

When sufficient force is applied to handwheel 66, shaft 60 snaps around so the adjacent flat portion 76 is adjacent surface 98 thereby locking the shaft against free rotation. Therefore, when shaft 60 is at rest with no rotational force being applied to handwheel 66, the contact between a planar face 76 and planar surface 92 will prevent pinion 78 from rotating with respect to back plate 90 and retain support arm 20 in a fixed vertical position, thereby acting as a passive locking means. Raised top portion 100 of back plate 90 limits the extent to which support arm 20 can be lowered.

The embodiment illustrated and described above used a cam having a plurality of planar faces disposed about the circumference thereof. It will be understood that instead of a plurality of planar faces, another embodiment of the cam may comprise a plurality of equally spaced outwardly protruding projections disposed about the circumference of the shaft. When two adjacent projections engage the surface of planar portion 98, the shaft is locked against rotation. To rotate the shaft, a sufficient rotational force must be applied to increase the distance from the centre of the shaft to the contact point between the outer edge of the projection on the cam and the planar surface of the back plate from a low value (when two adjacent protruding portions on the cam equally engage the planar surface 98), to a high value which occurs when a single outwardly protruding portion contacts the planar surface 98. Free rotation is avoided by ensuring the force needed to rotate the shaft is greater than any incidental forces acting on the seat back. Edges 79 of cam 74 in FIG. 2 may be viewed as outwardly projecting protrusions.

Shaft 60 and back plate 90 are preferably fabricated of a material which is sufficiently hard to resist wear during the lifetime of seat back height adjustment mechanism 24 such as glass filled or glass reinforced nylon.

It will be apparent to those skilled in the art that the seat back height adjustment mechanism disclosed herein may be attached in a various ways to a chair, such as it being attached to a seat tilt mechanism or independently of the seat tilt mechanism where only the height adjustment feature is required. In addition, it will be apparent to those skilled in the art that the rack may be integrally formed with the seat back support arm by for example being milled directly into the support arm wherein the cam member would be designed to engage the adjacent flat surface of the arm.

The seat back height adjustment mechanism disclosed herein is advantageous in that the rack and pinion arrangement requires the use of only one hand to raise and lower the seat back. Furthermore, no positive locking action is required in that the cam does not have to be tightened against the support arm but rather the locking action is achieved by the cam having a plurality of planar faces one of which is contiguous to a planar portion of the arm or back plate thereby preventing free rotation of the shaft.

While the chair seat back height adjustment mechanism forming the subject invention has been described and illustrated with respect to the preferred embodiment, it will be appreciated that numerous variations of this embodiment may be made without departing from the scope of the invention.

Therefore what is claimed is:

1. A height adjustment mechanism for a chair having a base portion and a seat back, said chair being of the type including a support arm attached to said back, said support arm having a rack extending there along, said mechanism comprising:

a) a mounting bracket attachable to said base portion of said chair, said mounting bracket for slidable reception of said support arm attached to said seat back of said chair;

b) a shaft member mounted to said mounting bracket for rotation about a rotational axis, said shaft member including means to facilitate its rotation, a pinion, and a cam means, said cam means having a plurality of circumferentially spaced outwardly protruding portions, said shaft member being positioned such that when said support arm is received by said mounting bracket, said pinion meshingly engages said rack and said cam means is in contiguous relationship with said support arm such that free rotation of said shaft is prevented by at least one of said protruding portions of said cam means; and c) one of said cam means and a portion of said support arm in contiguous relationship therewith being sufficiently resilient that, upon the application of sufficient torque to said shaft member, one of said protruding portions of said cam means moves along said support arm as said cam means is rotated such that said pinion engaging said rack rotates and displaces said support arm with respect to the mounting bracket.

2. A height adjustment mechanism according to claim 1 wherein said cam means is generally cylindrically shaped and includes a plurality of planar faces extending about the circumference thereof, adjacent planar faces being at an angle to each other, each of said protruding portions comprising an apex between said adjacent planar faces.

3. A height adjustment mechanism according to claim 2 wherein said mounting bracket is a clevis having a back wall and opposed side walls attached to said back wall, said support arm being slidably received between said side opposed walls.

4. A height adjustment mechanism according to claim 3 wherein said cam means, said pinion and said shaft member are of one piece unitary construction, said cam means and said pinion being in adjacent relation.

5. A height adjustment mechanism according to claim 4 wherein said support arm comprises a back plate attached thereto having a substantially planar portion, said rack forming part of said back plate and being adjacent to said planar portion.

6. A height adjustment mechanism according to claim 3 wherein the shaft member is an elongate shaft rotatably mounted between said opposed side walls of said clevis such that when assembled said cam means and pinion are mounted between said opposed side walls of the clevis.

7. A height adjustment mechanism according to claim 6 wherein said means for rotating said shaft member is a handwheel attached to an end portion of said shaft located on the exterior of the clevis.

8. A height adjustment mechanism according to claim 7 including a bracket insert contiguous to said bracket back wall and interposed between said back wall and said support arm.

9. A height adjustment mechanism according to claim 8 wherein said shaft and back plate are fabricated of glass filled nylon.

10. A chair comprising;

a) a chair base and a seat back;

b) one of said seat back and said chair base having a support arm attached thereto, and the other having a mounting bracket attachable thereto, said mounting bracket slidingly receiving said support arm;

c) a rack extending along said support arm; and d) a shaft member mounted to said mounting bracket for rotation about a rotational axis, said shaft member including means to facilitate its rotation, a pinion, and a cam means, said cam means having a plurality of circumferentially spaced outwardly protruding portions, said shaft member being positioned such that when said support arm is received by said mounting bracket, said pinion meshingly engages said rack and said cam means is in contiguous relationship with said support arm such that free rotation of said shaft is prevented by at least one of said protruding portions of said cam means; and d) one of said cam means and a portion of said support arm in contiguous relationship therewith being sufficiently resilient that, upon the application of sufficient torque to said shaft member, one of said protruding portions of said cam means moves along said support arm as said cam means is rotated such that said pinion engaging said rack rotates and displaces said support arm with respect to the mounting bracket.

11. A chair according to claim 10 wherein said cam means is generally cylindrical and includes a plurality of planar faces extending about the circumference thereof, adjacent planar faces being at an angle to each other each of said protruding portions comprising an apex between said adjacent planar faces.

12. A chair according to claim 11 wherein said mounting bracket is a clevis having a back wall and opposed side walls attached to said back wall, said support arm being slidably received between said side opposed walls.

13. A chair according to claim 12 wherein said cam means, said pinion and said shaft member are of one piece unitary construction, said cam means and said pinion being in adjacent relation.

14. A chair according to claim 13 wherein said support arm comprises a back plate attached thereto having a substantially planar portion, said rack forming part of said back plate and being adjacent to said planar portion.

15. A chair according to claim 12 wherein the shaft member is an elongate shaft rotatably mounted between said opposed side walls of said clevis such that when assembled said cam means and pinion are mounted between said opposed side walls of the clevis.

16. A chair according to claim 15 wherein said means for rotating said shaft member is a handwheel attached to an end portion of said shaft located on the exterior of the clevis.

17. A chair according to claim 16 including a bracket insert contiguous to said bracket back wall and interposed between said back wall and said support arm.

18. A chair according to claim 17 wherein said shaft and back plate are fabricated of glass filled nylon.

* * * * *

UNITED STATES PATENT AND TRADEMARK OFFICE

CERTIFICATE OF CORRECTION

PATENT NO. : 5,405,189

DATED : April 11, 1995

INVENTOR(S) : William S. Stumpf

It is certified that error appears in the above-indentified patent and that said Letters Patent is hereby corrected as shown below:

Column 3, line 38, delete "toughened" and insert --roughened --.

Signed and Sealed this

Twenty-fourth Day of October, 1995

*Attest:*

*Attesting Officer*

BRUCE LEHMAN

*Commissioner of Patents and Trademarks*